US006296127B1

(12) United States Patent
Tseng

(10) Patent No.: US 6,296,127 B1
(45) Date of Patent: Oct. 2, 2001

(54) STATIONERY ORGANIZER

(76) Inventor: Rong-Chun Tseng, No. 8-1, Chihsin Lane, Kuanghsing Rd., Taiping City, Taichung County (TW)

( * ) Notice: Subject to any disclaimer, the term of this patent is extended or adjusted under 35 U.S.C. 154(b) by 0 days.

(21) Appl. No.: 09/666,306

(22) Filed: Sep. 21, 2000

(51) Int. Cl.[7] ..... A47F 5/00

(52) U.S. Cl. ..... 211/45; 211/47; 211/163; 211/69.1; 40/377

(58) Field of Search ..... 211/163, 69.1, 211/45, 47, 164; 40/377, 124

(56) References Cited

U.S. PATENT DOCUMENTS

D. 272,584 * 2/1984 Barber .
3,334,950 * 8/1967 Brownlee .
3,868,916 * 3/1975 Ohlson ..... 211/163 X
3,918,017 * 11/1975 McGannon et al. .
3,998,334 * 12/1976 Smith ..... 211/45
4,052,113 * 10/1977 Broome .
4,426,007 * 1/1984 Beleckis et al. ..... 211/47 X
4,586,614 * 5/1986 Ger ..... 211/163 X
6,119,381 * 9/2000 Grocholski ..... 40/377 X

* cited by examiner

*Primary Examiner*—Robert W. Gibson, Jr.
(74) *Attorney, Agent, or Firm*—Rosenberg, Klein & Lee

(57) ABSTRACT

A stationery organizer includes a rotary table supported on a base, the rotary table having an upright post, a plurality of stepped bushings respectively mounted on the upright post of the rotary table and longitudinally connected in a line, a screw cap fastened to the upright post to secure the stepped bushings to the upright post, and a plurality of springy plastic retainer flap elements detachably radially fastened to the stepped bushings around the upright post and closely attached to one another for holding stationery items in sector-like receiving space in each plastic retainer flap element or in between each two adjacent plastic retainer flap elements.

2 Claims, 4 Drawing Sheets

STATIONERY ORGANIZER

BACKGROUND OF THE INVENTION

The present invention relates to a stationery organizer adapted for holding a variety of stationery items and, more particularly to such a stationery organizer that can be conveniently adjusted to hold different volume and sizes of storage stationery items.

A variety of stationery containers and holders are commercially available for use to hold sheets of paper, pens, rules, knives, cutters, erasers, scissors, correction fluid dispensers, clips, and etc. These stationery containers and holders are commonly designed for holding particular stationery items, and not for all-purpose. Further, these conventional stationery containers and holders cannot be adjusted to fit different volume and sizes of storage stationery items.

SUMMARY OF THE INVENTION

The invention has been accomplished to provide a stationery organizer, which eliminates the aforesaid drawbacks. It is one object of the present invention to provide a stationery organizer, which has variable holding spaces for holding different stationery items. It is another object of the present invention to provide a stationery organizer, which can be conveniently adjusted to hold different volume and sizes of storage stationery items. According to one aspect of the present invention, the stationery organizer comprises a rotary table supported on a base, the rotary table having an upright post, a plurality of stepped bushings respectively mounted on the upright post of the rotary table and longitudinally connected in a line, a screw cap fastened to the upright post to secure the stepped bushings to the upright post, and a plurality of springy plastic retainer flap elements detachably radially fastened to the stepped bushings around the upright post and closely attached to one another. According to another aspect of the present invention, the stepped bushings each have a circular base and a coupling flange at the periphery of the circular base, and the plastic retainer flap elements each have a plurality of coupling notches detachably coupled to the coupling flange of each stepped bushing. According to still another aspect of the present invention, rules, sheets of paper, business cards, and other different flat stationery items can be inserted in between each two adjacent plastic retainer flap elements and secured thereto. According to still another aspect of the present invention, thick stationery items can be kept in the sector-like receiving space defined in each plastic retainer flap element.

DETAILED DESCRIPTION OF THE PREFERRED EMBODIMENT

Figures 1, 1A, 1B:
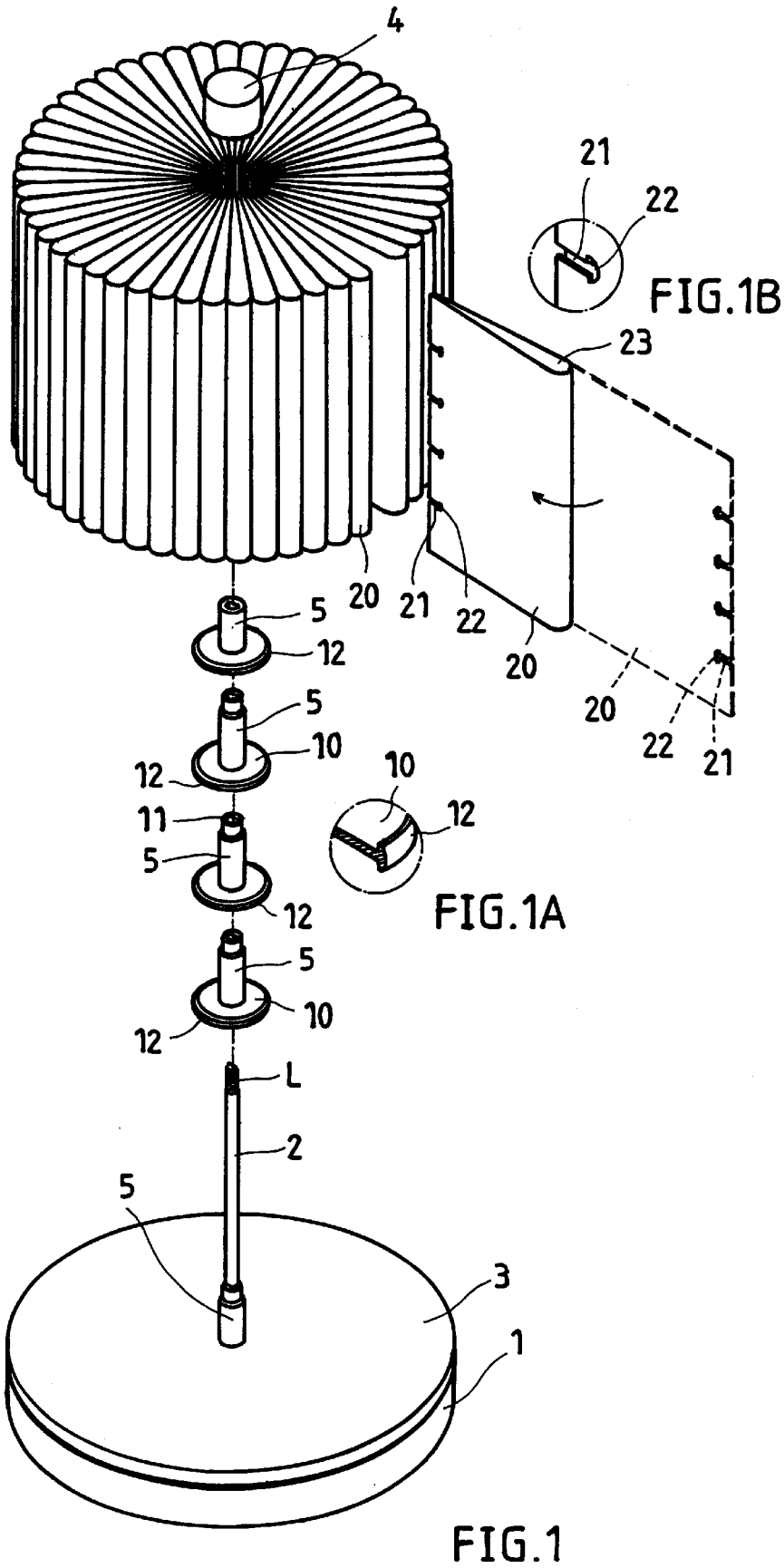
FIG. 1 is an exploded view of a stationery organizer according to the present invention.
FIG. 1A is a sectional elevation of a part of FIG. 1 showing the structure of the coupling flange of the hub.
FIG. 1B is an enlarged view of a part of FIG. 1 showing the structure of the coupling notch on the springy plastic retainer flap element.
Figure 2:
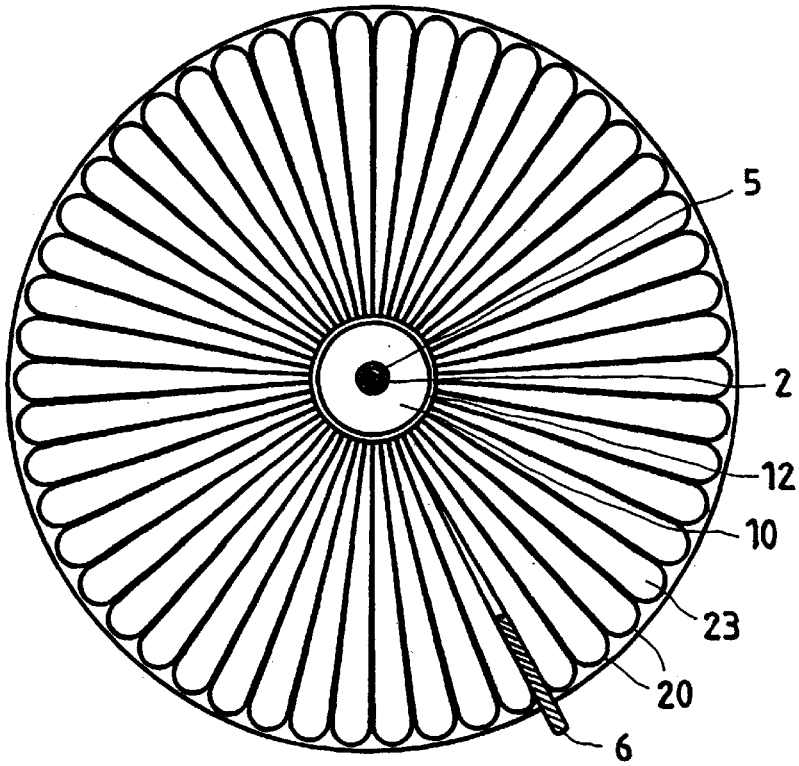
FIG. 2 is a top view in section of the stationery organizer according to the first embodiment of the present invention.

Referring to FIGS. from 1 through 4, a stationery organizer in accordance with the present invention is shown comprising a base 1, a rotary table 3 revolvably supported on the base 1, an upright post 2 perpendicularly raised from the center of the flat top surface of the rotary table 3, the upright post 2 having a threaded top end L, a plurality of stepped bushings 5 respectively mounted on the upright post 2 and vertically connected in a line, a screw cap 4 threaded onto the threaded top end L of the upright post 2 to secure the stepped bushings 5 to the upright post 2, and a plurality of springy plastic retainer Hap elements 20 respectively radially fastened to the stepped bushings 5 around the upright post 2 and closely attached to one another. The stepped bushings 5 each comprise a circular base 10, and a peripheral coupling flange 12 rose around the periphery of the circular base 10 at right angles. The springy plastic retainer flap elements 20 are made by bending a respective piece of springy plastic sheet material into shape, each comprising a plurality of transversely extended coupling notches 21 adapted for coupling to the circular base 10 of the stepped bushings 5. After a piece of springy plastic sheet material had been bent into shape to form a springy plastic retainer flap element 20, it defines a receiving space 23 of sector-like cross-section. The coupling notches 21 each have an en expanded inner end 22 adapted to receive the peripheral coupling flange 12 of the corresponding stepped bushing 5. When assembled, the plastic retainer flap elements 20 are supported on the rotary table 3, and can be rotated with the upright post 2 and the rotary table 3 relative to the base 1.

Figure 3:
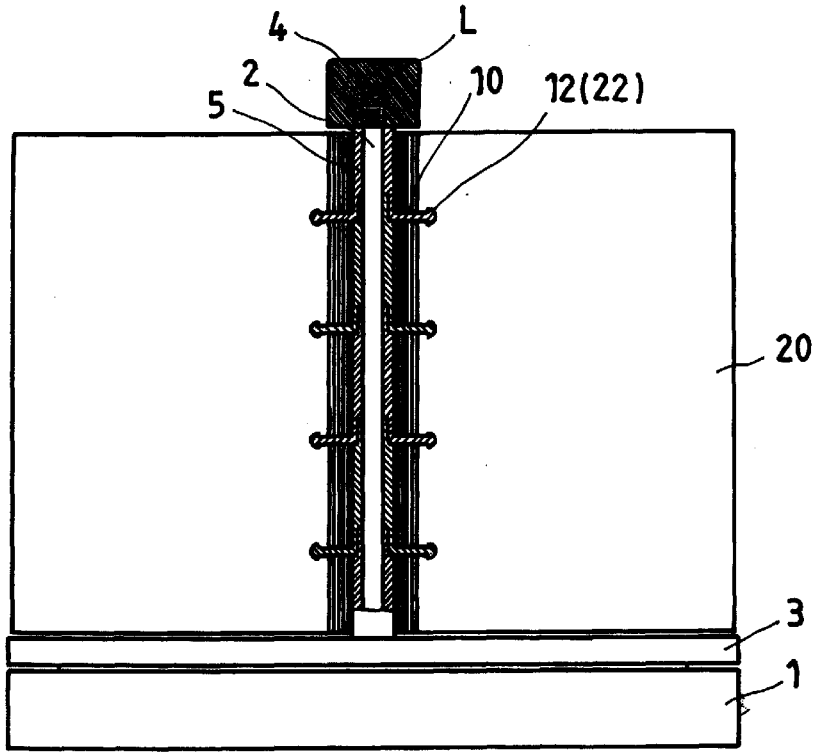
FIG. 3 is a front view in section of the stationery organizer shown in FIG. 1.
Figure 4:
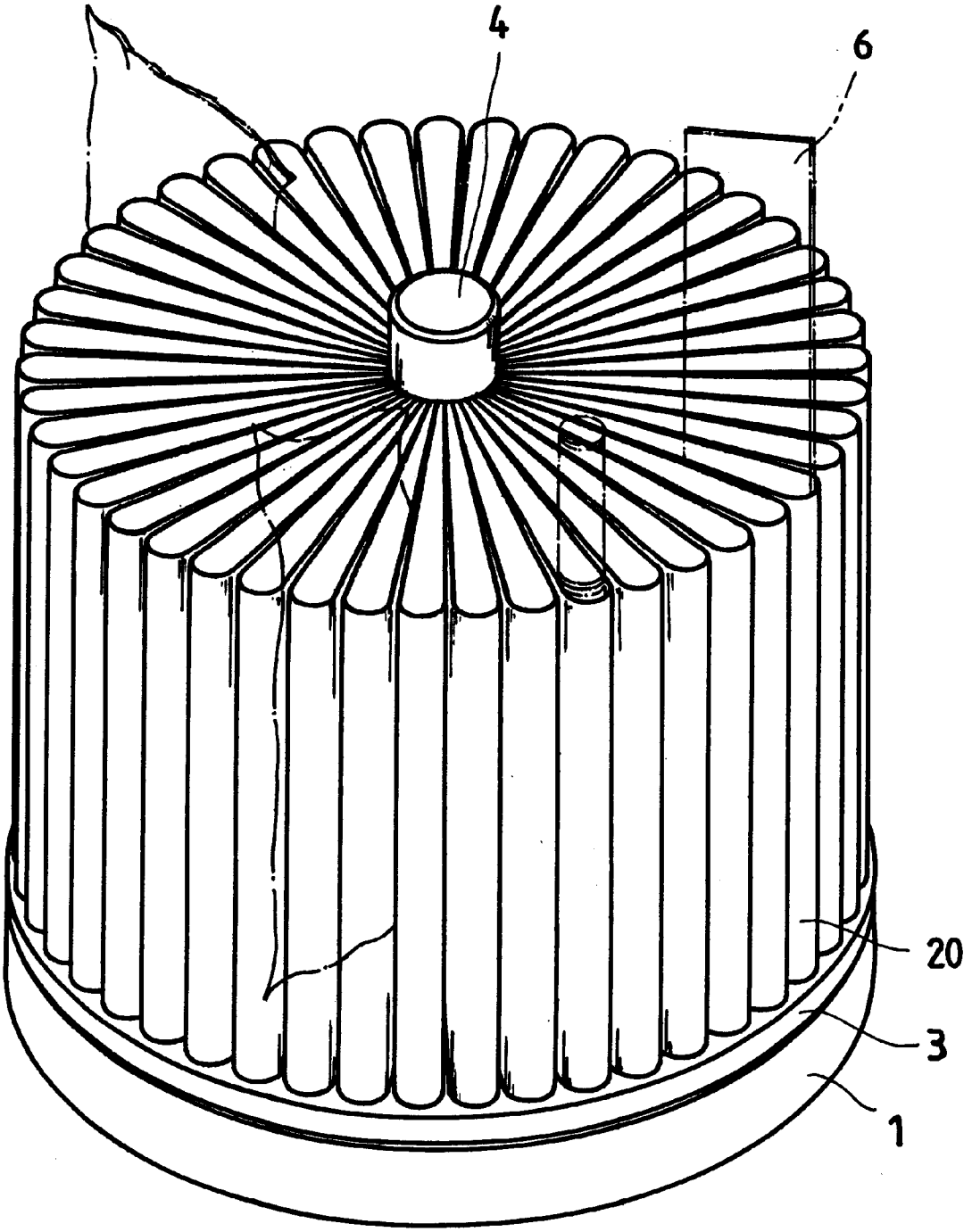
FIG. 4 is an elevational view in an enlarged scale of the stationery organizer shown in FIG. 1.

Referring to FIGS. 1A, 1B and 3 again, the coupling notches 21 of each plastic retainer flap element 20 fit the circular base 10 of each stepped bushing 5, and the expanded inner end 22 of each coupling notch 21 fits the peripheral coupling flange 12 of each stepped bushing 5. Because the plastic retainer flap elements 20 are springy, the plastic retainer flap elements 20 can be deformed, for enabling the coupling notches 21 and the respective expanded inner end 22 of each coupling notch 21 to be respectively coupled to the circular base 10 and peripheral coupling flange 12 of each stepped bushing 5. After installation, the plastic retainer flap elements 20 immediately return to their former shape, keeping the respective coupling notches 21 positively secured to the circular base 10 of each stepped bushing 5. Further, the plastic retainer flap elements 20 can easily be disconnected from the stepped bushings 5 when pulled outwards with the hand. Because the plastic retainer flap elements 20 can easily be installed in or disconnected from the stepped bushings 5, the user can adjust the number of the plastic retainer flap elements 20 to fit different volume and sizes of storage stationery items.

Referring to FIGS. from 2 through 4 again, because the plastic retainer flap elements 20 are springy and closely attached to one another around the upright post 2, flat stationery items 6 (for example, rules, business cards, sheets of paper, and etc.) can be inserted in between each two adjacent plastic retainer flap elements 20 and secured thereto. Stationery items such as rules, knifes, cutters, scissors, and etc., can be kept in the receiving space 23 in each plastic retainer flap element 20 and supported on the rotary table 3. The user can rotate the rotary table 3 on the base 1 to move the desired storage items to the side facing the user.

Figure 5:
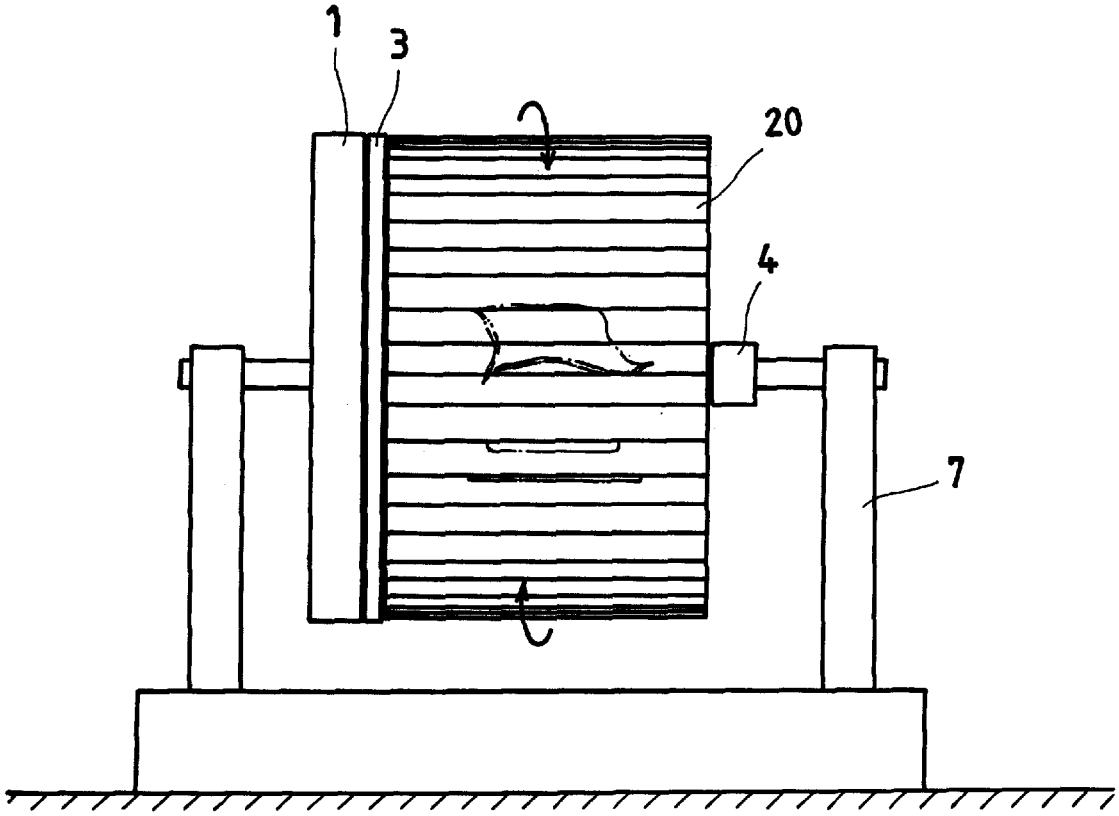
FIG. 5 illustrates an alternate form of the stationery organizer according to the present invention.

FIG. 5 shows an alternate form of the present invention. According to this alternate form, a stand 7 is provided to hold the stationery organizer in a horizontal position, enabling the plastic retainer flap elements 20 to be turned with the rotary table 3 about a horizontal axis.

It is to be understood that the drawings are designed for purposes of illustration only, and are not intended for use as a definition of the limits and scope of the invention disclosed.

What the invention claimed is:

1. A stationery organizer comprising:

a base;

a rotary table supported on said base, said rotary table including an upright post extending perpendicularly from the center of a flat top surface of said rotary table, said upright post having a threaded distal end;

a plurality of stepped bushings respectively mounted on the upright post of said rotary table and longitudinally connected in aligned manner, said stepped bushings each including a circular base and a peripheral coupling flange raised normally around the periphery of said circular base;

a screw cap threaded onto the threaded distal end of said upright post to secure said stepped bushings to said upright post; and, a plurality of springy plastic retainer flap elements respectively radially fastened to said stepped bushings around said upright post and closely disposed adjacent one another, said springy plastic retainer flap elements each defining a receiving space of sector-like cross-section and including a plurality of transversely extended coupling notches respectively coupled to the circular base of said stepped bushings, said transversely extended coupling notches each having an expanded inner end fitting the peripheral coupling flange of a corresponding one of said stepped bushings.

2. The stationery organizer of claim 1 further comprising a stand adapted to hold said base in a vertical position for enabling said plastic retainer flap elements to be turned with said rotary table about a horizontal axis.

* * * * *